US008491343B2

(12) United States Patent
Wang et al.

(10) Patent No.: US 8,491,343 B2
(45) Date of Patent: Jul. 23, 2013

(54) SOCKET ASSEMBLY

(75) Inventors: Jun-Hui Wang, Shenzhen (CN); Li-Ren Fu, Shenzhen (CN); Han-Bing Zhang, Shenzhen (CN); Al-Ling He, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 63 days.

(21) Appl. No.: 13/232,984

(22) Filed: Sep. 14, 2011

(65) Prior Publication Data

US 2013/0052840 A1 Feb. 28, 2013

(30) Foreign Application Priority Data

Aug. 29, 2011 (CN) ..... 2011 1 0250818

(51) Int. Cl.
*H01H 25/00* (2006.01)

(52) U.S. Cl.
USPC ..... 439/640

(58) Field of Classification Search
USPC ..... 439/32, 120, 216, 640, 171, 214, 439/652, 690, 110; 174/48
See application file for complete search history.

(56) References Cited

U.S. PATENT DOCUMENTS 1,590,569 A * 6/1926 Fisk ..... 439/17
2,042,105 A * 5/1936 Kelley ..... 191/23 R
2,052,312 A * 8/1936 Nielsen ..... 191/23 R
2,076,558 A * 4/1937 Hartman et al. ..... 191/23 R
2,170,298 A * 8/1939 Frank ..... 191/23 A
2,332,766 A * 10/1943 Von Gehr ..... 191/23 R
2,617,849 A * 11/1952 Wright et al. ..... 191/23 R
3,659,247 A * 4/1972 Chaney et al. ..... 439/32
3,772,482 A * 11/1973 Ross, Jr. ..... 191/23 R
4,720,953 A * 1/1988 Onishi et al. ..... 174/497
4,750,899 A * 6/1988 Scarimbolo ..... 139/121
5,052,937 A * 10/1991 Glen ..... 439/120
D325,562 S * 4/1992 Smith, Sr. ..... D13/139.1
5,206,972 A * 5/1993 Nudelmont et al. ..... 16/95 R
5,418,328 A * 5/1995 Nadeau ..... 174/494
6,178,094 B1 * 1/2001 Hakozaki ..... 361/796
6,484,360 B1 * 11/2002 DeBartolo et al. ..... 16/95 R
6,647,590 B2 * 11/2003 Haab et al. ..... 16/90
7,094,077 B1 * 8/2006 Chen ..... 439/118
7,128,585 B2 * 10/2006 Evilsizer ..... 439/120
7,201,589 B2 * 4/2007 Jong ..... 439/94
7,438,566 B2 * 10/2008 Chen ..... 439/110
7,544,071 B2 * 6/2009 Jong ..... 439/113
7,722,367 B2 * 5/2010 Jong ..... 439/118
7,833,027 B2 * 11/2010 Jong ..... 439/118

* cited by examiner

*Primary Examiner* — Amy Cohen Johnson
*Assistant Examiner* — Vladimir Imas
(74) *Attorney, Agent, or Firm* — Altis Law Group, Inc.

(57) ABSTRACT

A socket assembly includes a base and a number of sockets. The base includes a bottom wall and two sidewalls. A conductive base is formed on the bottom wall and forms at least two conductive pieces parallel to the sidewalls. An extension plate extends from the top of one of the sidewalls toward the other sidewall. A number of cutouts are defined in the bottom surface of the extension plate. Each socket includes a main body and a fixing member mounted on the top of the main body. The manipulation of the fixing member allows the repositioning of a socket within the base, or the removal of a socket.

9 Claims, 3 Drawing Sheets

SOCKET ASSEMBLY

BACKGROUND

1. Technical Field

The present disclosure relates to a socket assembly.

2. Description of Related Art

Socket bars have a number of sockets to couple with the plugs of electronic devices. However, the positions of the sockets of the bar are fixed and immovable. When plugs of a certain shape are coupled with the corresponding sockets of a socket bar of this type, some spaces neighboring those sockets may be occupied. Furthermore, the numbers of the sockets of the socket bar are also fixed, which is inconvenient if extra electronic devices need to be connected.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are isometric, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
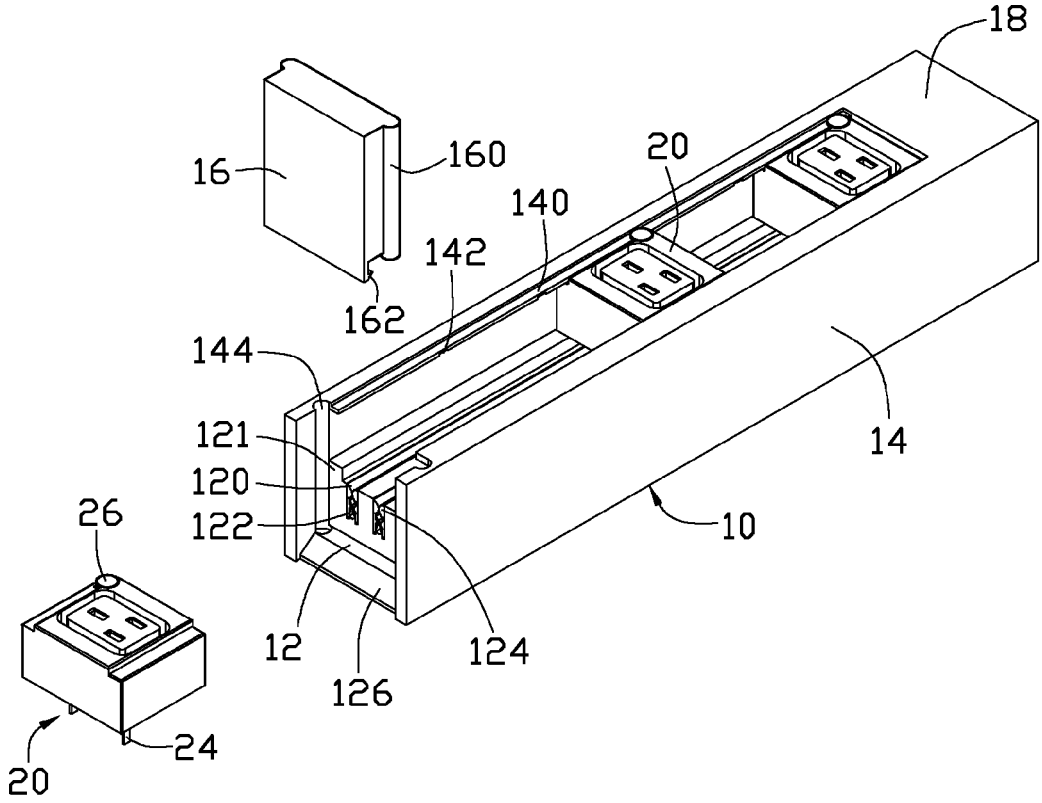
FIG. 1 is an exploded, isometric view of an exemplary embodiment of a socket assembly having a plurality of sockets.

Referring to FIG. 1, an exemplary embodiment of a socket assembly includes a cuboid holder 10, and a plurality of sockets 20 slidably mounted to the holder 10.

The holder 10 includes a bottom wall 12, and two sidewalls 14 extending up from the bottom wall 12, an end wall 16 detachably mounted to a first end of the holder 10, and an end portion 18 integrally formed at a second end of the holder 10. A slanted latch portion 126 is formed at the bottom wall 12 near the first end of the holder 10. A semicircular groove (slot 144) is defined on the inside of each sidewall 14, in a direction perpendicular to the bottom wall 12, near the latch portion 126. A flange 140 extends inward from the top of each sidewall 14. A number of rectangular positioning recesses 142 are regularly spaced on the bottom of one of the flanges 140 and each recess 142 extends the width of the flange 14. A base member 121 made of insulating material is received in the holder 10, located at the bottom wall 12 and sandwiched between the sidewalls 14. The base member 121 includes three sliding grooves 120 extending the length of the base member 121, each groove contains a conductive piece 122 which connects respectively to the live, the ground and the neutral wires from a power source. Two access-restricting shields or plates (isolating members 124) are built in to the top of each sliding groove 120, abutting one another and covering the corresponding conductive piece 122.

The end wall 16 has longitudinal bulges (poles 160) at each side, shaped and sized to match the slots 144. A hook 162 extends downward from the bottom of the end wall 16 to latch with the bottom wall 12.

Figure 2:
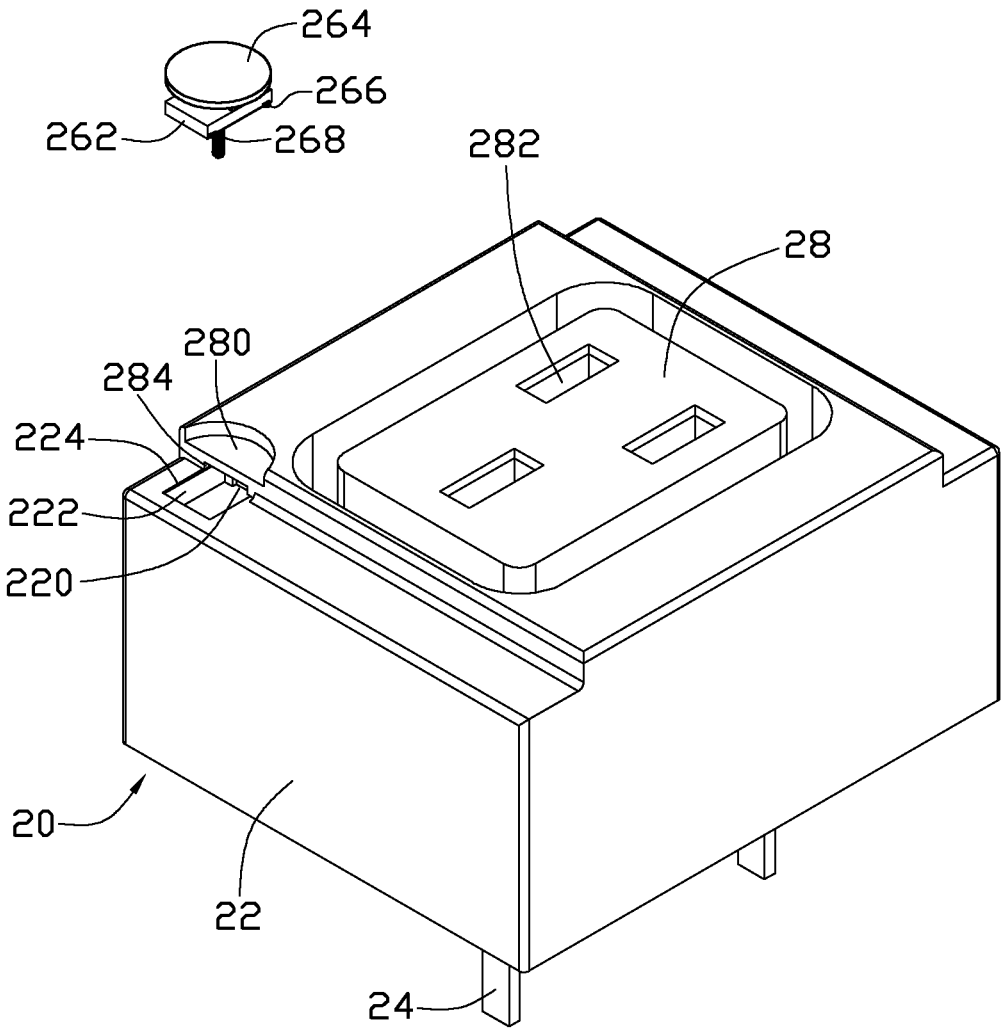
FIG. 2 is an enlarged view of one of the sockets of FIG. 1.

Referring to FIG. 2, each socket 20 includes a main body 22, and a button 26. Three pins 24 extend downward from the bottom of the main body 22, and correspond positionally to the three sliding grooves 120. A rectangular platform 28 is formed at the top of the main body 22. The platform 28 defines three inserting holes 282 in the center, in accordance with any mains electricity supply standard. One corner of the platform 28 defines a semicircular cutout 280 in an upper portion thereof, and a rectangular cutout 284 in a lower portion thereof below the semicircular cutout 280. A receiving space 220 is defined in the top of the main body 22 and communicates with the rectangular cutout 284 of the platform 28. A pair of blocking tabs 224 forms the side boundaries of the receiving space 222. An opening is defined between the two tabs 224. The button 26 includes a rectangular engaging plate 262, a round operating member 264 parallel to the engaging plate 262, and a connecting shank (not shown) perpendicularly disposed between the engaging plate 262 and the operating member 264. Two pairs of elastic projections 266 extend from opposite sides of the bottom of the engaging plate 262. A resilient member 268 is positioned underneath the engaging plate 262. In this embodiment, the resilient member 268 is a coil spring.

Figure 3:
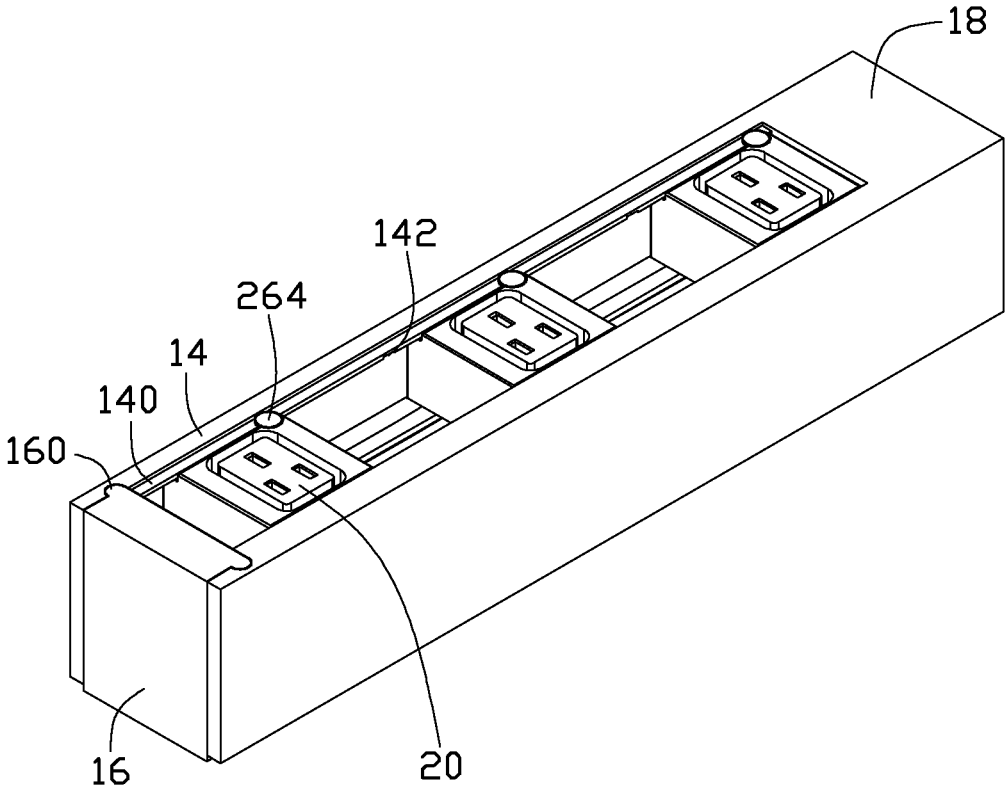
FIG. 3 is an isometric view of the assembled socket assembly of FIG. 1.

Referring to FIG. 3, in the fitting of each socket 20, the resilient member 268 and the engaging plate 262 are inserted into the receiving space 220 of the main body 22 through the opening 222. The resilient member 268 is compressed between the main body 22 and the bottom of the engaging plate 262. The projections 266 are deformed to be received in the receiving space 220 and then held captive by the blocking tabs 224. The engaging plate 262 partially extends into the rectangular cutout 284; the top of the engaging plate 262 is blocked by the platform 28 above the cutout 284. The operating portion 264 is partially received in the semicircular cutout 280.

In the holder 10, the three pins 24 of each socket 20 extend into the three sliding grooves 120 to engage with the conductive pieces 122. Each pin 24 of the socket 20 is sandwiched between the two isolating members 124 of the corresponding sliding groove 120. In fitting the socket 20 to the holder 10, the top of the socket 20 beside the platform 28 slides underneath engages with the bottoms of the flanges 140 and the resilient member 268 is further deformed. When the socket 20 is slid along the holder 10, the operating member 264 will be pushed up by spring pressure when the engaging plate 262 aligns and engages with a positioning recess 142, and that engagement will lock the socket 20 in that particular position.

The end wall 16 is then mounted to the holder 10, with the poles 160 engaging in the slots 144 and the hook 162 sliding along the slanted portion 126 until blocked by the bottom of the bottom wall 12.

To change the spacing between sockets, or release the socket 20 from the holder 10, the hook 162 is detached from the bottom wall 12 and the end wall 16 is moved upward from the holder 10. The operating member 264 of the socket 20 is pressed down to release the engaging plate 262 from the positioning recess 142, thereby allowing the easy repositioning or removal of the socket 20.

In another embodiment, the holder 10 may define two sliding grooves 120, and two pins 24 from the bottom of each socket 20 to connect to the live and the neutral wire from a power source.

It is believed that the present embodiments and their advantages will be understood from the foregoing description, and various changes may be made thereto without departing from the spirit and scope of the description or sacrificing all of their material advantages, the examples hereinbefore described merely being exemplary embodiments.

What is claimed is:

1. A socket assembly, comprising:

a holder comprising a bottom wall, and two sidewalls respectively extending from opposite sides of the bottom wall, a base member received in the holder and defining at least two sliding grooves parallel to the sidewalls and each receiving a conductive piece, a flange extending from one of the two sidewalls toward the other of the two sidewalls and defining a plurality of positioning recesses in a bottom of the flange; and a plurality of sockets each comprising a main body and a button, at least two pins extending from the main body to be slidably received in the at least two sliding grooves to electrically engage with the conductive pieces, the button attached to the main body and movable in a direction perpendicular to the sliding direction of the sockets, the button comprising an engaging plate configured to be selectively engaged in one of the positioning recesses of the flange to position the socket in the holder.

2. The socket assembly of claim 1, wherein the holder further comprises a detachable end wall, each sidewall defines a slot adjacent to one end thereof in a direction perpendicular to the bottom wall, each slot has a C-shaped cross-section, two poles extend from opposite sides of the end wall to detachably engage in the slots.

3. The socket assembly of claim 2, wherein a slanted latch portion is formed at the end of the bottom wall near the slots, a hook extends from an end of the end wall to hook with the slanted latch portion.

4. The socket assembly of claim 1, wherein the base member is made of insulating material, two elastic isolating members extend from opposite sides bounding each sliding groove above the corresponding conductive piece, one abutting against another.

5. The socket assembly of claim 1, wherein the main body of the button comprises a rectangular platform formed at the top of the main body, one corner of the platform defines a first cutout in an upper portion and a second cutout in a lower portion, a receiving space is defined in the main body to communicate with the second cutout, the engaging plate of the button is received in the receiving space and partially received in the second cutout of the main body, the button further comprises an operating member located above the engaging plate and partially received in first cutout of the main body.

6. The socket assembly of claim 5, wherein the first cutout is semicircular and the operating member is round.

7. The socket assembly of claim 5, wherein a resilient member is attached to the engaging plate and is compressed by the engaging plate and a portion of the main body below the receiving space.

8. The socket assembly of claim 5, wherein two blocking tabs extend from two sides bounded the receiving space toward each other, two projections extend from opposite sides of the engaging plate to be blocked by the corresponding blocking tabs.

9. The socket assembly of claim 1, wherein the number of the at least two sliding grooves is three, and the three conductive pieces received in the three sliding grooves are to respectively connect to the hot line, ground line, and neutral line of a power supply, and the number of the at least two pins of each socket is three.

* * * * *